US005735777A

United States Patent [19]

Benoit et al.

[11] Patent Number: 5,735,777

[45] Date of Patent: Apr. 7, 1998

[54] ADAPTIVE WEIGHT DEVICE

[75] Inventors: Kenneth J. Benoit, 4 Factory Cove Rd., Boothbay Harbor, Me. 04538; John Li, Bellflower, Calif.

[73] Assignee: Kenneth J. Benoit, Booth Bay Harbor, Me.

[21] Appl. No.: 714,680

[22] Filed: Sep. 16, 1996

Related U.S. Application Data

[63] Continuation-in-part of Ser. No. 351,668, Dec. 8, 1994, abandoned.

[51] Int. Cl.[6] ..... A63B 21/075

[52] U.S. Cl. ..... 482/93; 482/106; 482/108

[58] Field of Search ..... 482/92–94, 106–108, 482/908, 98; 248/309.4, 206.5; 403/DIG. 1; 29/DIG. 95; 269/8

[56] References Cited

U.S. PATENT DOCUMENTS

| | | | |
|---|---|---|---|
| 2,554,874 | 5/1951 | Oetzel | 335/288 |
| 3,320,564 | 5/1967 | Sosey et al. | 335/285 |
| 4,935,080 | 6/1990 | Hassell et al. | 310/154 |
| 4,971,305 | 11/1990 | Rennex . | |
| 5,040,787 | 8/1991 | Brotman . | |
| 5,117,141 | 5/1992 | Hawsey et al. | 310/156 |
| 5,137,502 | 8/1992 | Anastasi | 482/106 |
| 5,256,121 | 10/1993 | Brotman . | |
| 5,267,927 | 12/1993 | Catanzano et al. | 482/105 |
| 5,331,062 | 7/1994 | Sorathia et al. | 525/454 |
| 5,344,375 | 9/1994 | Cooper | 482/108 |
| 5,407,413 | 4/1995 | Kupferman | 482/93 |

FOREIGN PATENT DOCUMENTS

| | | | |
|---|---|---|---|
| 2600541 | 12/1987 | France | 482/108 |

OTHER PUBLICATIONS

Charles Mayer Studios, Inc., Rubber Magnet Paint, Advertisement from 1960, 2 pages.

Hardy and Padmore, New Dumb–Bells, "Invention", London, p. 32, Sep. 1887.

*Primary Examiner*—Jerome Donnelly
*Assistant Examiner*—Victor K. Hwang
*Attorney, Agent, or Firm*—Chris A. Caseiro; Thomas L. Bohan

[57] ABSTRACT

An adaptive weight device for supplementing the weight to be moved using standard exercise weight equipment. The adaptive weight device includes a weight component fabricated into a shape essentially conforming to the shape of the standard equipment to which it is removably attached. The device is removably attached to the standard weight equipment by a plurality of small magnets equally spaced on the side of the weight component that interfaces with the weight equipment. The magnets are positioned within retention seats of the weight component wherein so that they are either flush with the surface of the weight component or so that they extend slightly beyond that surface. The adaptive weight device of the present invention may be used with bar-mounted as well as stand-alone weight equipment. In either case the attachment design of the adaptive weight device ensures a balanced load when the device is added to the equipment.

17 Claims, 3 Drawing Sheets

ADAPTIVE WEIGHT DEVICE

This is a continuation-in-part of application Ser. No. 08,351,668, filed Dec. 8, 1994, now abandoned.

BACKGROUND OF THE INVENTION

1. Field of the Invention

The present invention relates to exercise weights. More particularly, the present invention relates to supplemental weights that may be easily attached to and removed from standard weightlifting equipment in order to increase the weight to be moved in increments smaller than those presently available with such equipment. The supplemental weights of the present invention may be attached using magnetic means and they are designed to conform with the profile of the weight equipment.

2. Description of the Prior Art

Weightlifting exercise equipment such as free weights and wire-restricted systems are used for a variety of reasons by a variety of individuals. For some people, weights are used to rehabilitate injured muscles and ligaments; for others, weights are used to increase muscle mass for increased strength and/or to enhance muscle tone. The young and the old, the weak and the strong, men and women all use weights for these reasons. Weightlifting can be performed in an individual's home. It is often done in a health club, gym, or other facility that can afford to stock the considerable amount of expensive equipment required for a complete workout. The standard free weight equipment generally available includes dumbbells and barbells, both of which have either fixed or adjustable weights. Dumbbells may come in a variety of sizes with incremental increases of five pounds or more. A dumbbell is normally gripped in one hand and used to exercise relatively small muscle groups. Fixed dumbbells come in two types, one being a solitary unit of a predetermined weight value and the other being a small bar having a plurality of individual plates retained on the bar by a permanent collar or stationary endcap. Adjustable dumbbells have removable collars that permit the user to add or remove individual plates to the bar. Barbells are generally used to exercise larger muscle groups and typically come in increments of five pounds or more. An individual generally exercises the larger muscle groups using a single barbell to which fixed or adjustable weights are applied. When the barbell is a fixed-weight type, individual plates are permanently secured on the ends of the bar by means of a permanent collar or stationary endcap. Adjustable barbell equipment operates in much the same way as the adjustable dumbbell. That is, the user can add or remove individual plates to the bar by removing the collar, changing the weight, and re-applying the collar. An individual using fixed-weight equipment must use a plurality of pieces of equipment in order to vary the weight to be lifted. An individual using adjustable-weight must take the time to add and remove weight as required.

For an individual interested in exercising in the privacy of his or her own home, it may be possible to purchase a limited number of free weight pieces of various sizes in order to accomplish a particular goal. Much more commonly, the individual must go to a health club or gym to work out since it is such a facility that makes the investment in the necessary equipment. Unfortunately, because of space and cost limitations, it is not possible for such a facility to obtain all of the equipment needed to meet the needs of all individuals. That is, for some people, incremental weight increases of five or ten pounds can be handled without concern that the muscles will be overstressed. For many people however, it is necessary to increase the weight to be moved in much smaller increments. Even those individuals with considerable strength may require smaller weight increases when they reach a lifting plateau or when they exercise very small muscles. Since it is not feasible to have the variety of dumbbells, barbells, and individual plates that would be needed to suit every person's needs, attempts have been made to add small weights to the existing equipment in order to produce smaller increases without great increases in cost and needed room.

Prior attempts at providing smaller incremental increases in free weight exercise equipment have been less than successful. It has been observed that many of those attempts involved the fabrication of unique devices, unique in that they could not be adapted to the standard dumbbells, barbells, and plates that are widely available and widely accepted. It is unlikely that such devices would be incorporated into the store of equipment available at most health clubs.

One prior device that seeks to be adaptive to standard weight equipment is the auxiliary device disclosed by Brotman (U.S. Pat. No. 5,256,121). The Brotman device comprises a weighted element and it includes a magnet used to releasably attach the element to a typical plate. The Brotman system suffers from a number of deficiencies that render it less than useful in normal weight training, deficiencies that must be addressed in any sort of incremental weight device. In particular, an adaptive weight system must be designed to be balanced. That is, for example, when plates are used with one or more plates on one side of the barbell or dumbbell, and a like number of plates of equal weight on the other side of the bar, any supplemental weight must be added in a balanced manner. If a supplemental weight of 2½ pounds were added to the right side of the bar, a supplemental weight of 2½ pounds would have to be added to the left side.

Of equal importance is the need to ensure that each of the supplemental weights does not "unbalance" the particular side that it is on. That can occur when the total weight of the supplemental weight is not distributed uniformly around the center of the barbell (or the center of the dumbbell if that is to be the weight carrier). It is well known in the field of weight training that even a small imbalance of the type noted can affect the individual in a negative way, such as by causing an error in lifting technique and/or by causing injury. The device disclosed by Brotman fails to address this problem in that it teaches an auxiliary weight device that may be applied in an imbalanced way to the standard plate. Specifically, Brotman describes the application of a rectangular auxiliary weight piece applied at one or more off-center locations on a round plate wherein the user selects the location. It would require a considerable amount of time and a greater amount of patience for an individual undertaking a number of exercises to ensure precise balancing of the auxiliary weights. The time involved in ensuring proper balance would be unacceptable in a health club where many people tend to use the same pieces of equipment.

Another problem that must be addressed in a suitable adaptive weight device is that of ensuring that the device will remain on the primary weight under the rigorous conditions associated with weightlifting. That is, there must be reasonable assurance that when the barbell or dumbbell is in use, the device will stay on. Further, when attached to the plate or dumbbell, the device should be attached sufficiently well to withstand shearing forces that will occur when the barbell or dumbbell falls or is dropped. The auxiliary weight disclosed by Brotman includes two strips of magnetized metal as the means of attachment. It is well known that most commonly available weights have uneven surfaces. It is unlikely that the Brotman strips can maintain complete contact with the surface to which they are applied. As a result, the attachment force is less than optimal and unexpected detachment could occur. An individual using such a system would be forced to find the best fit between the two irregular surfaces. Unfortunately, that position of greatest surface contact may not be in an area that provides the weight balance required and discussed above. A further related problem with the Brotman device is the apparent location of the center of mass of the device relatively far from the contact area of the strips. As the barbell or dumbbell is moved, that distant center of mass is likely to add to the shearing stress on the attachment strips, further increasing the possibility of unexpected detachment.

Another deficiency associated with the prior-art adaptive weight devices relates to the conformity of those devices with the profile of the standard dumbbell or plate to which they are attached. In addition to providing an aesthetically-pleasing appearance, which adds to the desirability of using the device, a profile that conforms to the plate or dumbbell and that does not extend much beyond the length of the base renders the device easier to use in confined areas, particularly in health clubs and gyms. Furthermore, for such a device with a "slim" profile, the center of mass of the device is close to the structure to which it is attached and therefore it is less likely to be removed unexpectedly.

Yet another problem with prior-art supplemental weight devices is the expense associated with them. Since such devices are add-ons that may or may not be needed with the standard equipment to which they are attached, they cannot be particularly expensive. Any such device which is fabricated of a variety of components formed of various materials is likely to be expensive to produce and therefore expensive to the consumer. It is unlikely that a person interested in supplementing weight equipment with add-on pieces would be interested in spending more for such add-on pieces than for the standard weight equipment.

Therefore, what is needed is an adaptive weight system for weightlifting equipment that can be removably attached to a fixed or adjustable weight element, such as a plate or dumbbell, while providing reasonable assurance that it will remain attached over the course of an exercise. What is also needed is an adaptive weight system that can readily and easily be applied so that it provides a balanced supplemental weight to the equipment to which it is attached. Further, what is needed is an adaptive weight system of limited profile essentially conforming to the profile of the equipment to which it is attached. Still further, what is needed is an adaptive weight system that is inexpensive to provide in comparison to the equipment to which it is attached.

SUMMARY OF THE INVENTION

It is an object of the present invention to provide an adaptive weight system that can be removably attached to standard weightlifting equipment in a way that ensures the adaptive weight will not fall off unexpectedly. Another object of the present invention is to provide an adaptive weight system that can easily be oriented on the equipment to which it is attached so that the entire weight to be moved by an individual remains balanced. Yet another object of the present invention is to provide an adaptive weight system with dimensions that limit the profile of the adaptive weight so that it extends little, if at all, beyond the dimensions of the primary weight unit. Still another object of the present invention is to provide an adaptive weight system that can be produced inexpensively.

These and other objectives are achieved in the present invention by the introduction of an adaptive weight system including attachment means uniformly spaced and affixed on the surface of a supplemental weight component. The attachment means is designed to removably attach the supplemental weight component to the exercise equipment, whether that equipment is a fixed plate, a removable plate, a fixed dumbbell or adjustable dumbbell. Furthermore, the attachment means of the present invention can be used to attach the supplemental weight component to wire-restricted equipment, such as Universal or Nautilus brand equipment. Any type of means may be used to removably attach the supplemental weight to the primary weight, including hook-and-loop means or magnets. The weight component may be fabricated in a variety of shapes, including round, such that it matches the shape of a typical barbell plate, hexagonal so that it matches the shape of the non-grip area of a unitary fixed dumbbell, or the like. When the adaptive weight is to be used in conjunction with a barbell having collars designed to lock the weight plates in place, it preferably has a centered opening so that it can pass over either a fixed or removable collar and so that it can automatically be centered on the plate to which it is directly attached. In that way, the weight is automatically balanced about the center of the bar. The dimensions of the weight component may be varied in order to provide a variation in total weight. It is preferable to limit that thickness, however, so that the overall profile of the primary weight unit combined with the adaptive weight system is not much greater than the profile of the primary weight unit alone. In that way, the adaptive weight device can be used in locations where space is limited. In the preferred embodiment, the weight component of the present invention may be provided in ¼-pound increments ranging from about 1–5 pounds. However, the present invention is applicable for other weight increments, including those that are less than one pound, those that are more than four pounds, and in increments of less than ¼-pound.

The weight component of the present system includes a plurality of attachment locations for affixing the attachment means thereto. The attachment locations are spaced apart from each other, preferably equidistant, on one side of the weight component and they may be recessed into the surface of that one side, they may extend beyond that surface, or they may be partially recessed and partially extended. It is preferable to position and design the attachment means so that effects of variations in the surface of the plate or dumbbell to which they are affixed are minimized. In that regard, each of the individual attachment means of the present adaptive weight system is of limited surface area. Moreover, they may alternatively be fabricated with some give or flexibility so as to conform to those surface variations. This flexibility may be achieved by affixing a thin flexible coating to the weight component so that any variations in the contact surface of the primary equipment would essentially be filled in that coating. Minimizing the problems associated with surface variations is further achieved in the present invention by spacing the plurality of attachment means equally so that the adaptive weight system may be quickly and easily adjusted on the primary weight element (the plate or dumbbell for example) until the best fit is found, and without causing imbalance. The optional flexible coating described above may be used to seal the weight component and the magnets contained therein. Such a coating can also reduce damage or possible injury caused by dropping or throwing of the adaptive weight device of the present invention.

When the attachment means includes a plurality of magnets, at least one for each attachment location, the magnets may be permanently affixed to the weight component, although that is not required. The magnets may be permanently affixed to the weight component by joining the two elements with an adhesive, by mechanically fixing them together such as with a bolt, or by sealing them within pockets formed in the attachment side of the weight component. The magnets may be ceramic or magnetized metal; however, it has been observed that rare-earth magnets such as those based on Neodymium or europium have longer life and generally stronger magnetic fields, come in a wide array of sizes, and are commonly available.

In a preferred design of the present invention, the magnets may be positioned within pockets, or retention seats, of the attachment side such that they are not in direct contact with the sides of the retention seats. That is, they are preferably isolated from the sides by some magnetically-insulative material. That material may simply be an air gap, or it may be an insulative sleeve formed of plastic, aluminum, or other suitable non-magnetic material. This spacing of the magnet away from the sides of the retention seat enhances the magnetic effect of the magnet in the plane of the weight to which the adaptive device is to be attached. In that regard, the magnetism of the device is enhanced, further ensuring suitable attachment and the capability to reduce the amount of magnetic material required to achieve that attachment.

The adaptive weight system of the present invention is a simple, effective apparatus that permits individuals exercising with standard, commercially available weightlifting equipment to quickly and easily increase the weight in increments smaller than otherwise possible using such equipment. The system includes a weight component and attachment means, both of which are shaped and joined together so as to minimize surface profile and to ensure proper balance as well as complete safety under the conditions commonly experienced.

These and other advantages of the present invention will become apparent to those of common skill in this field upon review of the accompanying drawings, the detailed description, and the appended claims.

DETAILED DESCRIPTION OF THE PREFERRED EMBODIMENTS

Figure 1:
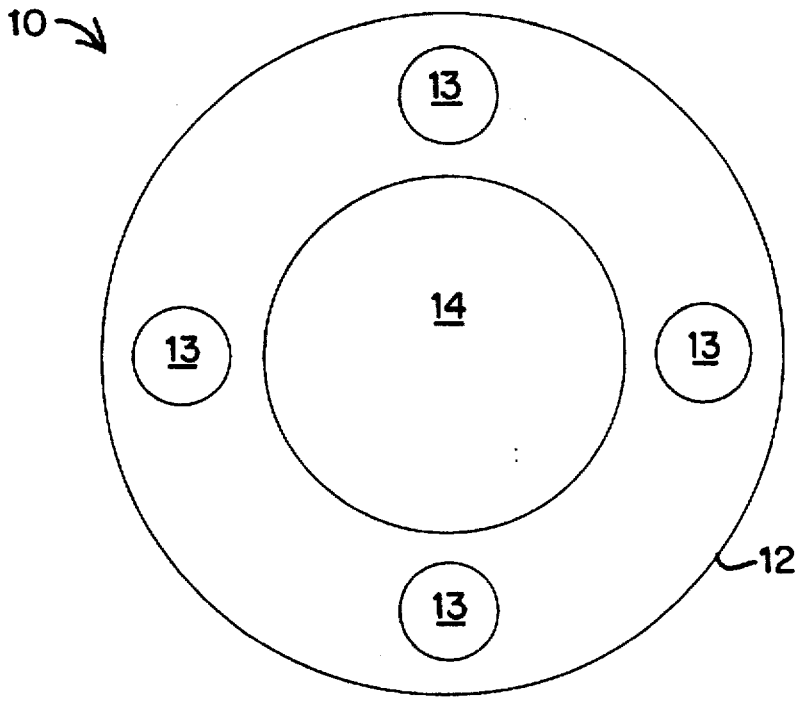
FIG. 1 is a front view of an adaptive weight device of the present invention for a plate located on a weight bar.
Figure 2:
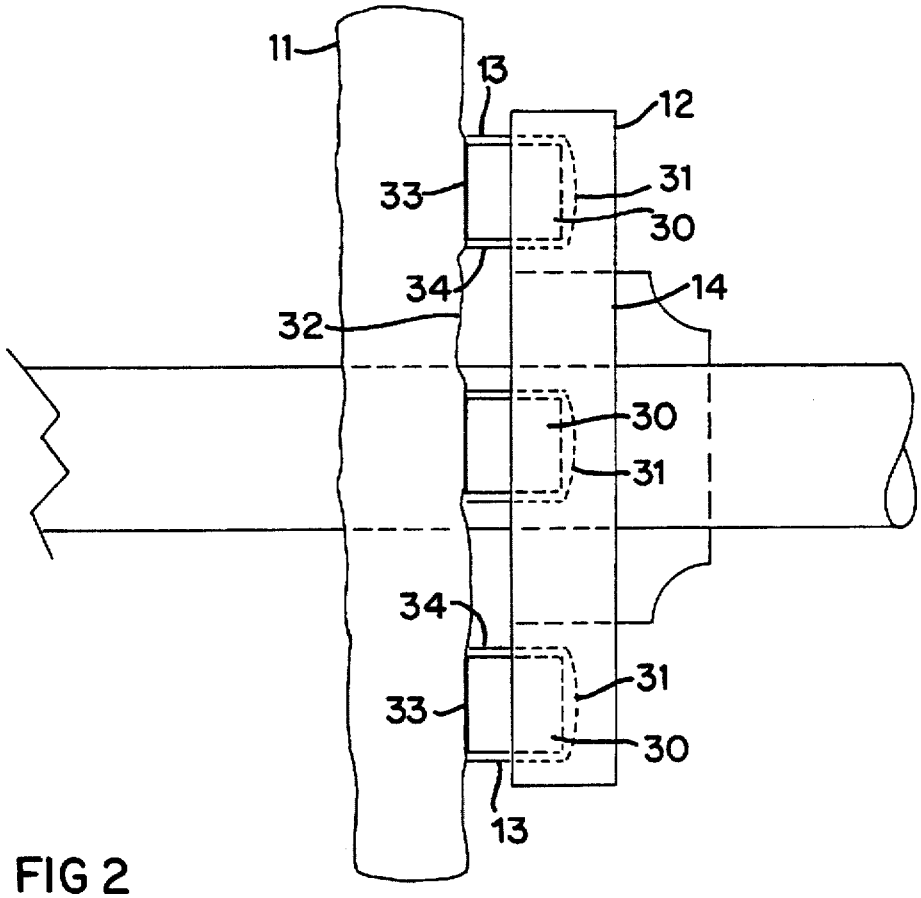
FIG. 2 is a side view of the adaptive weight device of the type illustrated in FIG. 1 removably affixed to a standard weight plate, showing attachment regions extending beyond the surface of the weight component of the present invention.
Figure 3:
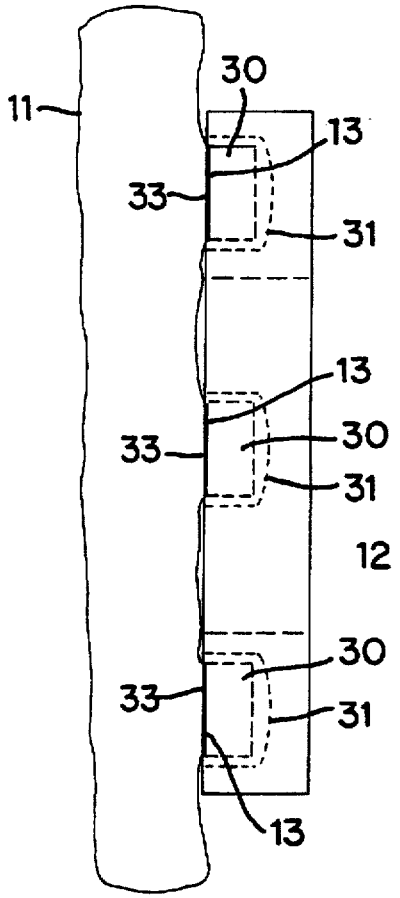
FIG. 3 is a side view of the adaptive weight device as illustrated in FIG. 2 and showing the attachment regions optionally placed flush with the surface of the weight component.
Figure 4:
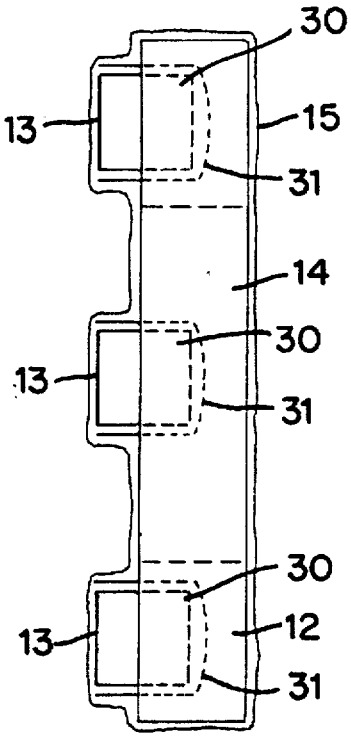
FIG. 4 is a side view of the adaptive weight device of the type illustrated in FIG. 1 showing the optional protective coating.

As illustrated in FIGS. 1–4, a first adaptive weight device 10 of the present invention is designed to be applied to a standard weight plate 11 of annular shape having an inner diameter of sufficient size to allow a standard bar to pass therethrough. The first adaptive weight device 10 includes a first weight component 12 and a plurality of attachment locations 13 for removably affixing the first weight device 10 to the weight plate 11. In order to ensure that the weight to be lifted by an individual remains balanced, there will generally be two adaptive weight devices used in conjunction with one another, one being applied to one standard weight plate at one end of the standard bar and the other of equal weight on a plate at the other end of the bar. The first weight component 12 may be fabricated of any suitable material, such as plastic, reinforced plastic, aluminum, iron, or combinations of non-metallic and metallic materials. In the preferred embodiment of the present invention the first weight component 12 is fabricated of cast iron and is molded, formed, or machined to a shape approximating the shape of the weight plate 11. That is, the first weight component 12 for the weight plate 11 shown in the drawings would be an annulus having an inner device diameter 14 of sufficient size to allow a standard bar to pass therethrough. Alternatively, the inner device diameter 14 may be sized to permit a standard collar—used to lock plates in place on a standard barbell—to pass therethrough. That alternative design would further reduce the time required to install and remove the first adaptive weight device 10. The first weight device 10 may further include an optional first protective coating 15 that may partially or completely seal the first weight component 12 and the attachment locations 13 therein. The optional first protective coating 15, illustrated in FIG. 4, may be included as part of the first weight device 10 as a means to protect the device from damage caused by haphazard usage, and to protect a user from injury. The first protective coating may be fabricated of any suitable material, including a viscoelastic material such as polyurethane. It may be bonded to the adaptive weight device or the coating may be applied as a liquid and allowed to cure.

Figure 5:
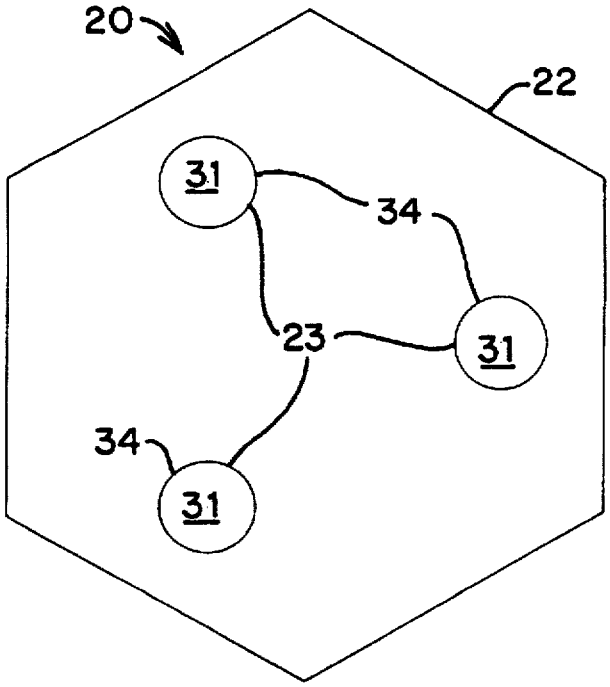
FIG. 5 is a front view of the adaptive weight device of the present invention for a dumbbell having hexagonally-shaped primary weight members.
Figure 6:
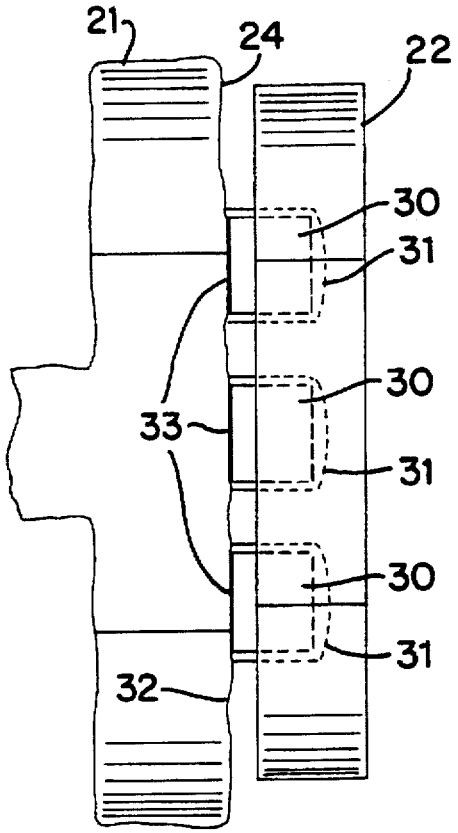
FIG. 6 is a side view of the adaptive weight device of the type illustrated in FIG. 5 removably affixed to a standard dumbbell, showing attachment regions extending beyond the surface of the weight component of the present invention.
Figure 7:
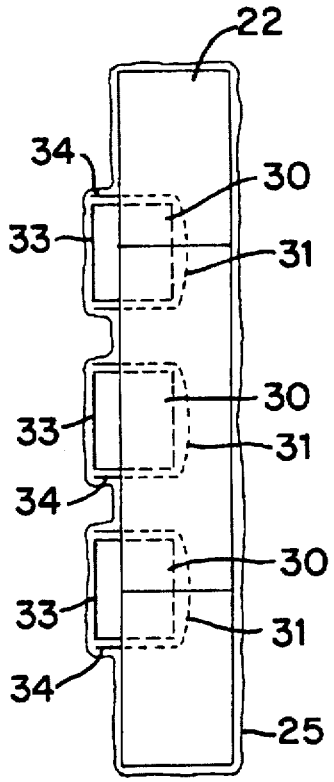
FIG. 7 is a side view of the adaptive weight device of the type illustrated in FIG. 5 showing the optional protective coating.

As illustrated in FIGS. 5–7, a second adaptive weight device 20 is designed as a solid member having no inner device diameter. The second adaptive weight device 20 is designed to be applied to standard weight equipment having solid ends, such as a dumbbell 21, that may be held in one hand and/or that does not have to be placed on a separate retaining bar. The second adaptive weight device 20 includes a second weight component 22 and a plurality of attachment locations 23 for removably affixing the second weight device 20 to a dumbbell end 24 of the dumbbell 21. As noted in the description of the first adaptive weight device 10, the second adaptive weight device 20 will be used with another device of equal weight placed on an opposite end of the dumbbell 21. The second weight component 22 may be fabricated of the same materials as indicated for the first weight component 12 and they may be made to conform to the shape of the dumbbell end 24. The second adaptive weight device 20 may also include a second protective coating 25, as illustrated in FIG. 7, for the reasons stated in the description of the first protective coating 15.

A key feature of the present invention is the means for attaching the first adaptive weight device 10 and the second adaptive weight device 20 to the plate 11 and the dumbbell 21, respectively. The attachment means of the present invention preferably includes a magnet 30 positioned within a magnet retention seat 31 located at each of the attachment locations 13 and, respectively, 23 of the first adaptive device 10 and the second adaptive device 20. The magnet retention seat 31 shown in the FIGURES is illustrated as partially recessed in the weight component of each device, and partially extended beyond an attachment surface 32 of the weight component. However, it is to be understood that the retention seat 31 may be fully recessed or it may be fully extended. The magnet 30 located within the retention seat 31 is preferably sized so that it fits snugly therein and such that a magnet surface 33 is essentially flush with a retention seat surface 34 that interfaces the attachment means with the plate 11 or the dumbbell end 24. As noted, each of the plurality of attachment locations includes a retention seat and magnet combination, such that there are two or more retention seats 31 and a corresponding plurality of magnets 30, with each retention seat 31 having at least one magnet located therein. The attachment locations 13, 23 are preferably spaced equidistant about the perimeter of the respective weight components so that the device user can select the best position on the plate 11 or the dumbbell end 24 for attachment of the device without causing an unbalancing. Of course, this ability to select the attachment position is important when interfacing the device with standard equipment, which rarely has completely flat surfaces for attachment.

As previously noted, the preferred means for attaching the adaptive weight devices 10, 20 to the standard equipment is the magnet 30. The magnet 30 may be secured in the retention seat 31 by bonding it to walls of the retention seat 31 with an adhesive 35, or by encapsulating the magnet 30 within the retention seat 31. The magnet 30 is preferably fabricated of a rare-earth metal, but it may be any suitable magnetic material, including ceramic-metal combination of the type well known by those skilled in that field. The magnet 30 may be fabricated in any shape, bearing in mind the goal to minimize the cost associated with this type of device. A simple shape, such as a cylinder, has been found to be satisfactory. The dimensions of the magnets 30 used for a particular adaptive weight device are dependent upon the weight of the weight components 12, 22 and the number of attachment locations 13, 23 used. For the first adaptive weight device 10 with the first weight component 12 being 2½ pounds and having three of the attachment locations 13 spaced equidistant about the perimeter of the weight component 12, it has been determined that each of the magnets 30 used, if formed as cylinders made of neodymium, should be about ½-inch in diameter and about ½-inch in height. A magnet with a nominal coercive force of about 9300 oersteds has been found to be particularly useful for this application. Of course, modifications in the number of attachment locations may require an adjustment in the size and strength of the magnet(s) to be used. A nickel-plated magnet alloy of neodymium and iron-boron provided by Master Magnetics, Inc. under the designation ND151N-27 is characteristic of a suitable magnet. It is to be understood, however, that other magnets would be effective as well.

Figure 8:
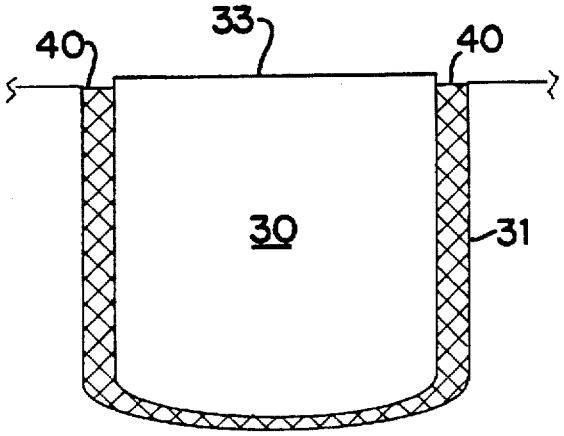
FIG. 8 is a front view of an alternative design of the magnets held within the retention seats, showing an insulative gap between the magnet and the interior sides of the retention seats.

In an alternative arrangement of the magnets 30 within the retention seats 31 shown in FIG. 8, an insulative gap 40 is designed to set the magnets 30 away from the interior side walls of the retention seats 31 so as to enhance the magnetic effect of the magnets 30. The magnets 30 may be carefully aligned substantially centered within the seats 31 and then bonded or otherwise attached to the bottom of the seats 31. Alternatively, the gap 40 may be achieved by the introduction of a magnetically-insulative sleeve that provides an automatic aligning of the magnets 30 within the seats 31.

Although the preferred embodiments of the present invention have been described in detail herein, it is to be understood that these descriptions are merely illustrative. The inventive apparatus may be modified in a variety of ways and equivalents in order to suit a particular purpose while still employing the unique concepts set forth.

What is claimed is:

1. An adaptive weight device comprising:

a weight component of a selected weight value and having an attachment side for coupling said weight component to an exercise weight, said attachment side including a plurality of localized retention seats spaced around a perimeter of said attachment side, wherein each of said retention seats includes retention walls and contains a permanent magnet fixedly positioned therein, wherein each of said magnets within said retention seats is sized so as to minimize the effect of surface variations of the exercise weight while maintaining sufficient magnetic strength to keep said weight component attached to the exercise weight when applied thereto wherein each of said retention seats includes an insulative gap spacing said permanent magnets from direct contact with said retention walls so as to enhance a magnetic effect of said permanent magnets, said adaptive weight device being removably attachable to the exercise weight and utilized for incrementally increasing an aggregate weight value of the exercise weight.

2. The adaptive weight device as claimed in claim 1 wherein said weight component is hexagonally shaped.

3. The adaptive weight device as claimed in claim 2 wherein the exercise weight is a hand-held dumbbell.

4. The adaptive weight device as claimed in claim 1 further comprising a protective coating applied to said attachment side of said weight component.

5. The adaptive weight device as claimed in claim 1 wherein said weight component is formed in the shape of an annular ring.

6. The adaptive weight device as claimed in claim 5 wherein said annular ring has an inner perimeter sized to permit a standard-sized retaining collar to pass therethrough.

7. The adaptive weight device as claimed in claim 1 wherein said weight component weighs about one and one-quarter pounds.

8. The adaptive weight device as claimed in claim 1 wherein said insulative gap is an air gap.

9. The adaptive weight device as claimed in claim 1 wherein said insulative gap is formed by an insulative sleeve surrounding said permanent magnet.

10. The adaptive weight device as claimed in claim 9 wherein said insulative sleeve is formed of a plastic.

11. An adaptive weight device comprising:

a weight component of a selected weight value formed in the shape of an annular ring and having an attachment side for coupling said weight component to an exercise weight, wherein an inner perimeter of said annular ring is designed to permit a standard-sized retaining collar to pass therethrough, said attachment side including a plurality of localized retention seats spaced around a perimeter of said attachment side, wherein each of said retention seats contains a permanent magnet fixedly positioned therein, wherein each of said magnets within said retention seats is sized so as to minimize the effect of surface variations of the exercise weight while maintaining sufficient magnetic strength to keep said weight component attached to the exercise weight when applied thereto, said adaptive weight device being removably attachable to the exercise weight and utilized for incrementally increasing an aggregate weight value of the exercise weight.

12. The adaptive weight device as claimed in claim 11 further comprising a protective coating applied to said attachment side of said weight component.

13. The adaptive weight device as claimed in claim 11 wherein said weight component weighs about one and one-quarter pounds.

14. The adaptive weight device as claimed in claim 11 wherein each of said retention seats includes an insulative gap spacing said permanent magnets from interior walls of said retention seats.

15. The adaptive weight device as claimed in claim 14 wherein said insulative gap is an air gap.

16. The adaptive weight device as claimed in claim 14 wherein said insulative gap is formed by an insulative sleeve substantially surrounding said permanent magnet.

17. The adaptive weight device as claimed in claim 16 wherein said insulative sleeve is formed of a plastic.

* * * * *